US010438553B2

(12) United States Patent
Kuei et al.

(10) Patent No.: US 10,438,553 B2
(45) Date of Patent: Oct. 8, 2019

(54) METHOD OF HANDLING OPERATION OF SOURCE DRIVER AND RELATED SOURCE DRIVER AND TIMING CONTROLLER

(71) Applicant: NOVATEK Microelectronics Corp., Hsin-Chu (TW)

(72) Inventors: Cheng-Kai Kuei, Hsinchu (TW); Sheng-Wen Lai, Tainan (TW); Chin-Hung Hsu, Taoyuan (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 70 days.

(21) Appl. No.: 15/633,732

(22) Filed: Jun. 26, 2017

(65) Prior Publication Data

US 2018/0374443 A1 Dec. 27, 2018

(51) Int. Cl.
*G09G 3/36* (2006.01)

(52) U.S. Cl.
CPC ..... *G09G 3/3677* (2013.01); *G09G 3/3611* (2013.01); *G09G 3/3688* (2013.01); *G09G 2310/0286* (2013.01); *G09G 2310/0291* (2013.01); *G09G 2310/08* (2013.01); *G09G 2330/021* (2013.01); *G09G 2330/022* (2013.01); *G09G 2340/16* (2013.01)

(58) Field of Classification Search
None
See application file for complete search history.

(56) References Cited

U.S. PATENT DOCUMENTS

2012/0026152 A1 2/2012 Chung
2013/0021306 A1* 1/2013 Kuo ..... G09G 3/20 345/204
2014/0168187 A1* 6/2014 Qu ..... G09G 3/20 345/212
2014/0253535 A1* 9/2014 Lim ..... G09G 5/008 345/213
2016/0104428 A1 4/2016 In
2018/0158408 A1 6/2018 Chae

FOREIGN PATENT DOCUMENTS

KR 10-2018-0066313 A 6/2018

* cited by examiner

*Primary Examiner* — Ifedayo B Iluyomade
(74) *Attorney, Agent, or Firm* — Winston Hsu

(57) ABSTRACT

A method of handling operation of a source driver of a display system used in a timing controller of a display system, which is coupled to the source driver via a data bus for delivering a plurality of line data, includes determining whether a first line data among the plurality of line data is identical to a second line data among the plurality of line data previous to the first line data; and transmitting a sleep command to the source driver when the first line data is determined to be identical to the second line data, wherein the sleep command instructs the source driver to enter a sleep mode; wherein the source driver stops receiving the plurality of line data from the timing controller when the source driver is in the sleep mode.

16 Claims, 6 Drawing Sheets

METHOD OF HANDLING OPERATION OF SOURCE DRIVER AND RELATED SOURCE DRIVER AND TIMING CONTROLLER

BACKGROUND OF THE INVENTION

1. Field of the Invention

The present invention relates to a method used in a display system, and more particularly, to a method of handling operation of a source driver and the related source driver and timing controller.

2. Description of the Prior Art

A display driver integrated circuit (IC) is a circuit used for driving a display panel. The display driver IC transmits signals or data to each row and column of pixels on the display panel, to drive the pixels of the display panel to display an image. For example, a thin-film transistor liquid crystal display (TFT LCD) is driven by a gate driver IC and a source driver IC. The gate driver IC is coupled to the gate terminal of the TFTs on the display panel, for turning the TFTs on or off. The source driver IC, which is coupled to the source terminal of the TFTs, transmits display data to the TFTs when the TFTs are turned on. The TFTs are turned on by the gate driver IC line by line, so the display data transmitted to the turned-on TFTs are called line data, which are received by a line of TFTs at a time.

In general, the gate driver IC and the source driver IC are controlled by a timing controller. The timing controller transmits line data to the source driver IC, which then forwards the line data to the display panel. After the source driver IC receives a line data from the timing controller, the line data is stored in a data latch of the source driver IC. When the source driver IC receives a load (LD) signal from the timing controller, the source driver IC transmits the line data, which is stored in the data latch, to the display panel . The source driver IC performs the above operations repeatedly no matter whether the newly received line data is identical to the previously received line data.

Please refer to FIG. 1, which is a waveform diagram of a conventional display system. In the conventional display system, a source driver is communicated with a timing controller and a display panel. FIG. 1 illustrates waveforms of line data, load (LD) signals and output data, where the line data and the LD signals are transmitted by the timing controller and received by the source driver. The output data, converted from the line data, is transmitted to the display panel by the source driver. In detail, the source driver receives the line data from the timing controller via a data bus, and then transmits the output data to the display panel when receiving an LD signal from the timing controller. The data is transmitted line by line, and each line data may be transmitted to a line of thin-film transistors (TFTs) on the display panel. For example, the source driver receives line data Y, Z, A, A, A, B, C and D in sequence. The received line data may be stored in a data latch of the source driver, and the line data stored in the data latch is outputted as the output data when the LD signal is received, as shown in FIG. 1.

Please note that the conventional source driver performs data reception and transmission repeatedly. Even if identical line data is received consecutively, the source driver may still write the identical line data into the data latch. Such an operation consumes additional power and gains no benefits. In such a situation, redundant power consumption is required since the same line data is rewritten into the data latch if a line data is identical to its previous line data. Thus, there is a need for improvement over the prior art.

SUMMARY OF THE INVENTION

It is therefore an objective of the present invention to provide a novel method of handling operation of the source driver and the related source driver and timing controller, allowing the source driver to enter a sleep mode to save power consumption when the timing controller determines that a line data is identical to its previous line data.

An embodiment of the present invention discloses a method of handling operation of a source driver of a display system used in a timing controller of the display system. The timing controller is coupled to the source driver via a data bus for delivering a plurality of line data. The method comprises determining whether a first line data among the plurality of line data is identical to a second line data among the plurality of line data previous to the first line data; and transmitting a sleep command to the source driver when the first line data is determined to be identical to the second line data, wherein the sleep command instructs the source driver to enter a sleep mode.

An embodiment of the present invention further discloses a method of handling operation of a source driver of a display system used in the source driver. The source driver is coupled to a timing controller of the display system via a data bus for delivering a plurality of line data. The method comprises receiving a sleep command from the timing controller; and entering a sleep mode to stop receiving the plurality of line data from the timing controller when the sleep command is received.

An embodiment of the present invention further discloses a timing controller of a display system. The timing controller, which is used for delivering a plurality of line data to a source driver via a data bus, comprises a determination module and a first data transmitter. The determination module is used for determining whether a first line data among the plurality of line data is identical to a second line data among the plurality of line data previous to the first line data. The first data transmitter is used for transmitting a sleep command to the source driver when the first line data is determined to be identical to the second line data, wherein the sleep command instructs the source driver to enter a sleep mode.

An embodiment of the present invention further discloses a source driver of a display system. The source driver comprises a data receiver and an output buffer. The data receiver is used for receiving a sleep command from a timing controller. The output buffer is used for transmitting a plurality of line data to a display panel of the display system. The source driver enters a sleep mode to stop receiving the plurality of line data from the timing controller when the sleep command is received.

These and other objectives of the present invention will no doubt become obvious to those of ordinary skill in the art after reading the following detailed description of the preferred embodiment that is illustrated in the various figures and drawings.

DETAILED DESCRIPTION

The present invention provides a method allowing the source driver to enter a sleep mode and stop receiving line data from the timing controller, in order to save power consumption. In such a situation, the source driver may still output the line data based on the data stored in the data latch, where the output data of the source driver may not be influenced.

Figure 1:
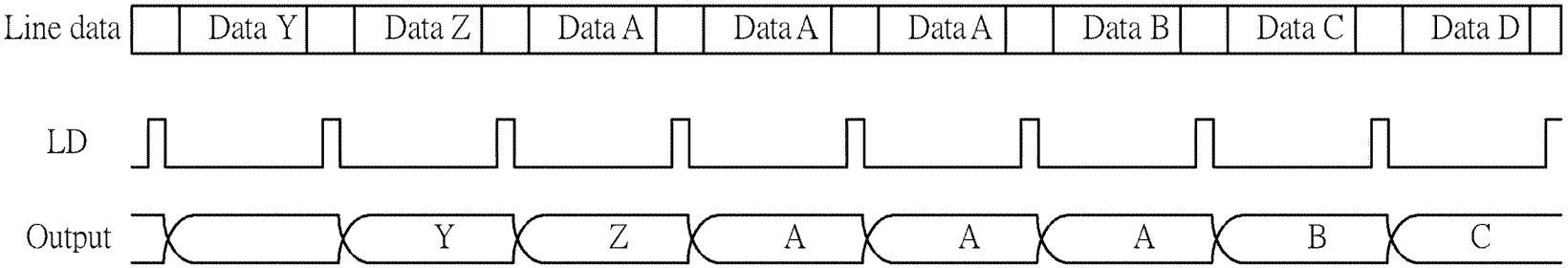
FIG. 1 PRIOR ART
FIG. 1 is a waveform diagram of a conventional display system.
Figure 2:
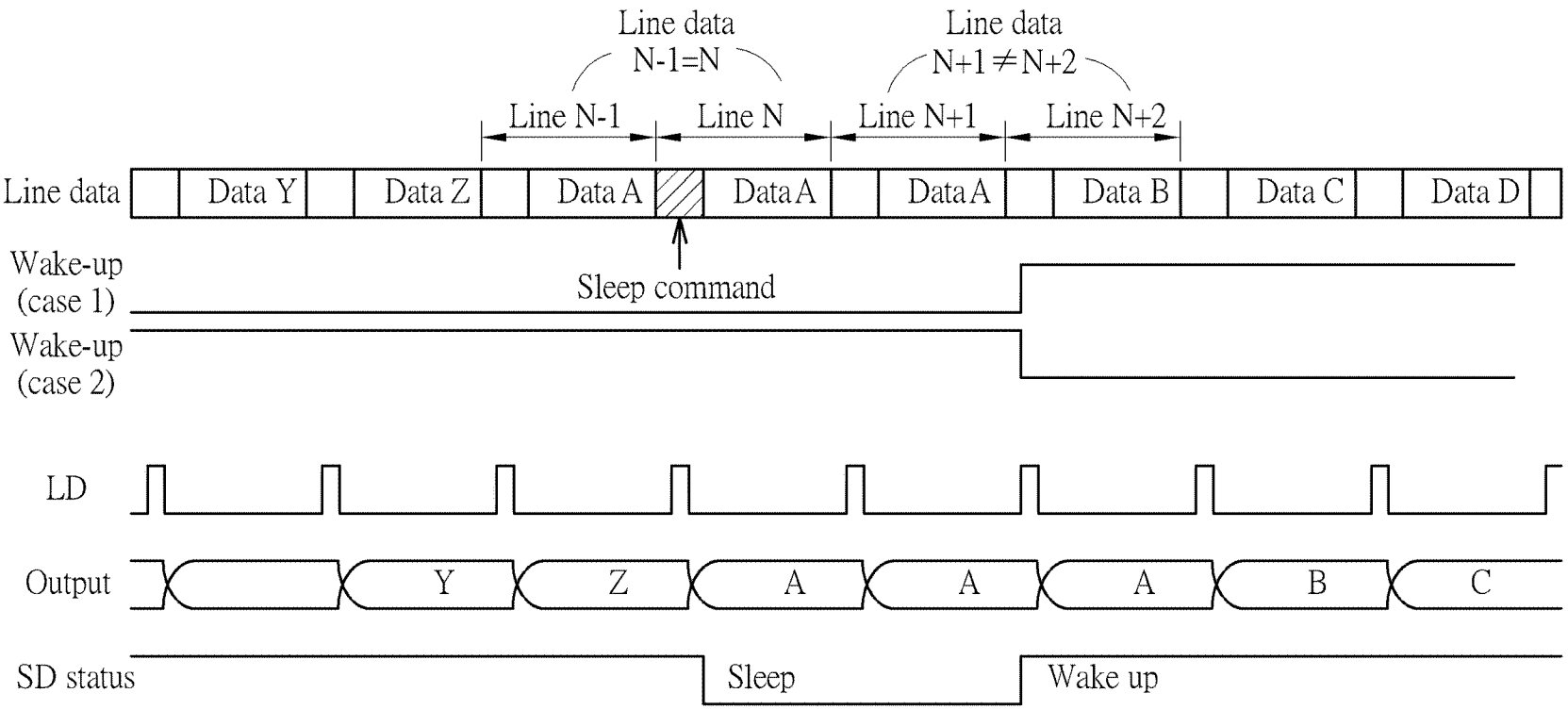
FIG. 2 is a waveform diagram of a display system according to an embodiment of the present invention.

Please refer to FIG. 2, which is a waveform diagram of a display system according to an embodiment of the present invention. Similarly, the source driver receives line data from the timing controller via the data bus and stores the line data in the data latch. When receiving the LD signal from the timing controller, the source driver outputs the output data to the display panel. In addition, the source driver further receives a sleep command and a wake-up command from the timing controller, where the sleep command instructs the source driver to enter the sleep mode, and the wake-up command instructs the source driver to exit the sleep mode. The waveform "SD status" refers to a flag or reference bit which indicates that the source driver is in the sleep mode or in the normal mode. For example, as shown in FIG. 2, "low" SD status means that the source driver is in the sleep mode, and "high" SD status means that the source driver is in the normal mode. In the sleep mode, the source driver may stop receiving line data from the timing controller. The flag or reference bit of "SD status" may be included in the source driver and also included in the timing controller; that is, the timing controller may always know the status of the source driver.

The timing controller may determine whether to instruct the source driver to enter the sleep mode according to the line data to be transmitted by the timing controller. If a line data to be transmitted is identical to its previous line data, the timing controller may transmit the sleep command to the source driver. For example, as shown in FIG. 2, the line data A is configured to be transmitted to lines N−1 and N, so that the two consecutive line data are identical. In such a situation, the timing controller may transmit a sleep command to the source driver via the data bus, where transmission of the sleep command is between the line data A for the lines N−1 and N. When receiving the sleep command, the source driver may enter the sleep mode and stop receiving the line data via the data bus, i.e., the data receiver of the source driver may be turned off, in order to save power consumption.

Subsequently, the timing controller may monitor whether a line data different from the line data A appears. In this embodiment, the timing controller may determine that a line data B is configured to be transmitted to the line N+2, while the line data A is configured to be transmitted to the line N+1. The timing controller thereby transmits the wake-up command to the source driver before transmitting the line data B. Note that the data receiver of the source driver has been turned off in the sleep mode; hence, the wake-up command cannot be transmitted via the data bus. Therefore, a control signal line other than the data bus may be applied to deliver the wake-up command. In general, there are several control signal lines already coupled between the timing controller and the source driver. For example, several control signal lines are used for transmitting control signals configured to control the display mode of the source driver. If a control signal is not triggered to operate its preconfigured function when the source driver is in the sleep mode, the corresponding control signal line may be applied to carry the wake-up command. The wake-up command may be realized in any control signal line coupled between the timing controller and the source driver, as long as the corresponding receiver module of the control signal line in the source driver is not turned off in the sleep mode. The selection of the control signal line should not be a limitation of the present invention.

In this embodiment, the wake-up command is represented by a toggle of a control bit, which may be a rising toggle from low to high (e.g., case 1) or a falling toggle from high to low (e.g., case 2) as shown in FIG. 2.

Figure 3:
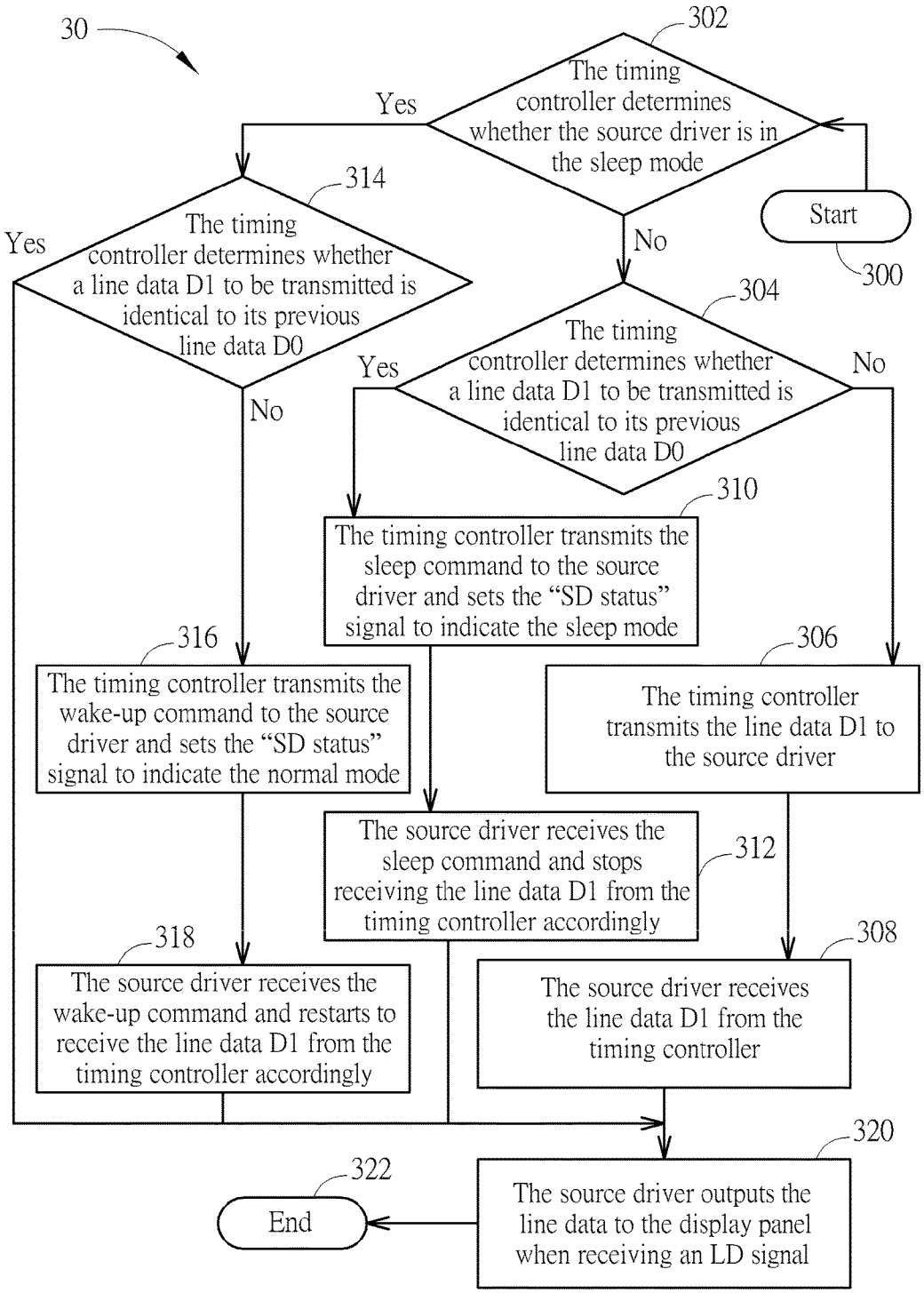
FIG. 3 is a flow chart of a process according to an embodiment of the present invention.

Please refer to FIG. 3, which is a flow chart of a process 30 according to an embodiment of the present invention. The process 30 may be used in a display system including a timing controller and a source driver, for controlling whether the source driver should be operated in a sleep mode. In this embodiment, the timing controller is coupled to the source driver via a data bus for delivering a plurality of line data. The process 30 includes the following steps:

Step 300: Start.

Step 302: The timing controller determines whether the source driver is in the sleep mode. If yes, go to Step 314; otherwise, go to Step 304.

Step 304: The timing controller determines whether a line data Dl to be transmitted is identical to its previous line data D0. If yes, go to Step 310; otherwise, go to Step 306.

Step 306: The timing controller transmits the line data D1 to the source driver.

Step 308: The source driver receives the line data D1 from the timing controller. Then, go to Step 320.

Step 310: The timing controller transmits the sleep command to the source driver and sets the "SD status" signal to indicate the sleep mode.

Step 312: The source driver receives the sleep command and stops receiving the line data D1 from the timing controller accordingly. Then, go to Step 320.

Step 314: The timing controller determines whether a line data D1 to be transmitted is identical to its previous line data D0. If yes, go to Step 320; otherwise, go to Step 316.

Step 316: The timing controller transmits the wake-up command to the source driver and sets the "SD status" signal to indicate the normal mode.

Step 318: The source driver receives the wake-up command and restarts to receive the line data D1 from the timing controller accordingly.

Step 320: The source driver outputs the line data to the display panel when receiving an LD signal.

Step 322: End.

According to the process 30, the timing controller determines whether the source driver is in the sleep mode (Step 302). Note that the timing controller includes the "SD status" signal which indicates whether the source driver is in the sleep mode or the normal mode.

If the source driver is in the normal mode, the timing controller determines whether a line data D1 to be transmitted is identical to its previous line data D0 (Step 304). If the line data D0 and D1 are determined to be not identical, the timing controller may transmit the line data D1 to the source driver via the data bus (Step 306), and the source driver may receive the line data D1 from the timing controller via the data bus correspondingly (Step 308). The source driver then stores the line data D1 in the data latch and then outputs the line data D1 to the display panel when receiving the LD signal from the timing controller (Step 320). On the other hand, if the line data D0 and D1 are determined to be identical, the timing controller determines to configure the source driver to enter the sleep mode. More specifically, the timing controller may transmit the sleep command to the source driver. The timing controller may also record this information by setting the "SD status" signal as shown in FIG. 2 (Step 310). Therefore, the source driver may receive the sleep command and enter the sleep mode accordingly; hence, the source driver stops receiving the line data D1 from the timing controller (Step 312), where the previous line data D0 has been received by the source driver and stored in the data latch before the sleep command is received. The line data D0 stored in the data latch may be outputted to the display panel when the source driver receives an LD signal corresponding to the line data D1 (Step 320), even if the line data D1 does not received by the source driver. Since the line data D1 is identical to the line data D0, outputting the line data D0 is the same as outputting the line data D1. In other words, the display data outputted to the display panel may not be influenced by the sleep operations of the source driver, and the sleep operations allow the source driver to consume less power when at least two consecutive line data are identical.

If the source driver is in the sleep mode, the timing controller determines whether a line data D1 to be transmitted is identical to its previous line data D0 (Step 314). If the line data D0 and D1 are determined to be not identical, the timing controller determines to configure the source driver to exit the sleep mode (or enter the normal mode). More specifically, the timing controller may transmit the wake-up command to the source driver. The timing controller may also record this information by setting the "SD status" signal as shown in FIG. 2 (Step 316). Therefore, the source driver may receive the wake-up command and exit the sleep mode (or enter the normal mode) accordingly; hence, the source driver restarts to receive the line data D1 from the timing controller (Step 318). The source driver then stores the line data D1 in the data latch and then outputs the line data D1 to the display panel when receiving the LD signal from the timing controller (Step 320). On the other hand, if the line data D0 and D1 are determined to be identical, the source driver may remain in the sleep mode and may not receive line data from the timing controller, where the corresponding data receiver may be turned off in the sleep mode. Therefore, the source driver may output the line data stored in the data latch to the display panel when receiving the LD signal (Step 320). When the source driver is in the sleep mode, the data receiver is turned off, while the output circuits of the source driver still operate normally. Therefore, the source driver may keep transmitting the identical line data to the display panel when it is in the sleep mode.

Figure 4:
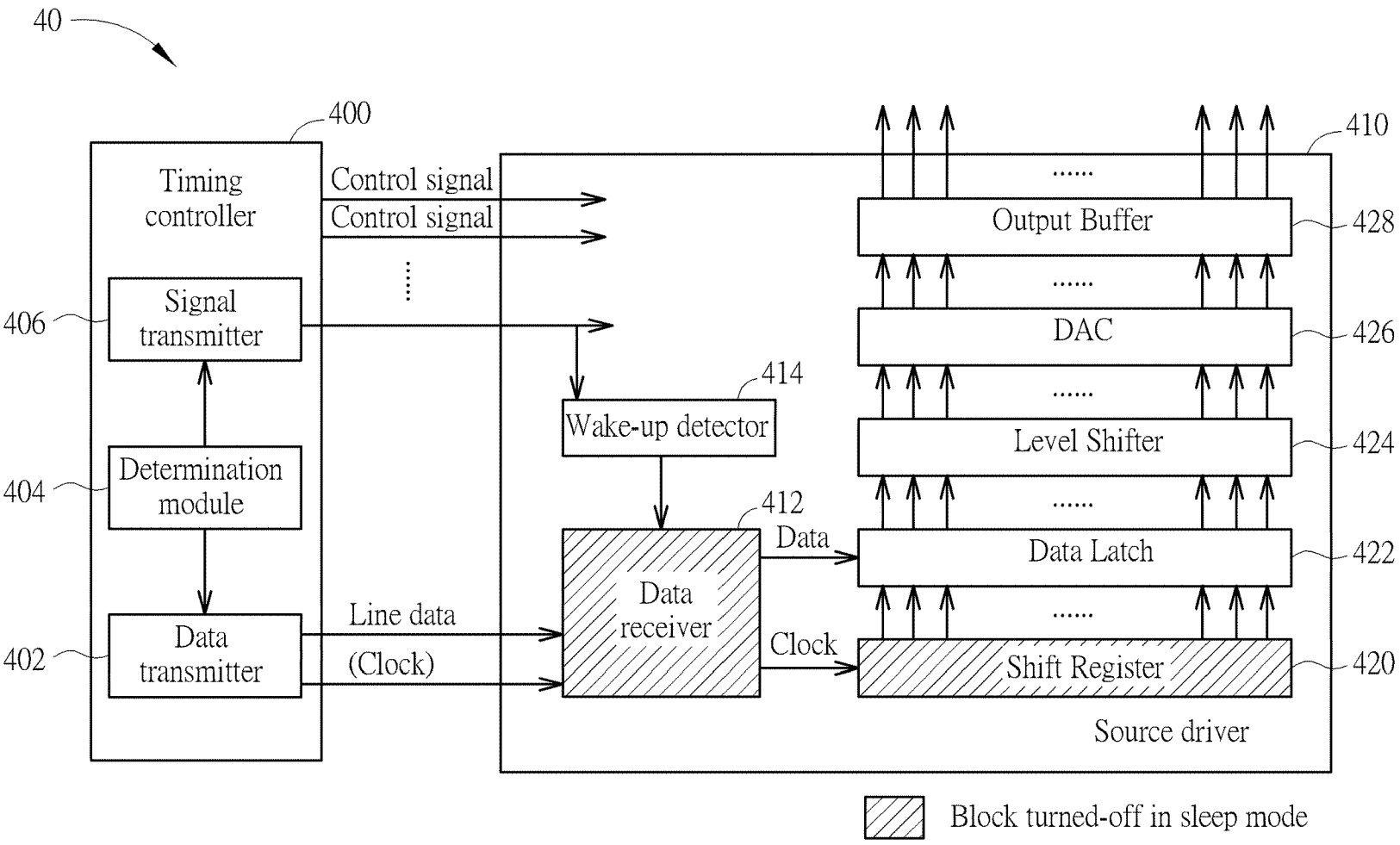
FIG. 4 is a schematic diagram of a display system according to an embodiment of the present invention.

Please refer to FIG. 4, which is a schematic diagram of a display system 40 according to an embodiment of the present invention. The display system 40 includes a timing controller 400 and a source driver 410. Those skilled in the art should realize that there may be more than one source driver controlled by a timing controller in a display system of the present invention, where only one source driver is illustrated herein for simplicity. The timing controller 400 includes a data transmitter 402, a determination module 404 and a signal transmitter 406. The determination module 404 is used for determining whether each line data is identical to its previous line data, and may be implemented with hardware or software. The data transmitter 402 is used for transmitting line data to the source driver 410 via a data bus, where a clock signal may be embedded in the line data or transmitted via another clock line according to the transmission scheme. When the determination module 404 determines that a line data (e.g., the data for line N) is identical to its previous line data (e.g., the data for line N−1) and the source driver 410 is in the normal mode, the determination module 404 notifies the data transmitter 402 to transmit a sleep command to the source driver 410. When the determination module 404 determines that a line data (e.g., the data for line N+2) is not identical to its previous line data (e.g., the data for line N+1) and the source driver 410 is in the sleep mode, the determination module 404 notifies the signal transmitter 406 to transmit a wake-up command to the source driver 410. As mentioned above, the signal transmitter 406 may be an existing module configured for an existing function and coupled to the source driver 410 via a control signal line; hence, the implementation of the wake-up operation may not increase any hardware cost.

The source driver 410 includes a data receiver 412, a wake-up detector 414, a shift register 420, a data latch 422, a level shifter 424, a digital-to-analog converter (DAC) 426 and an output buffer 428. The data receiver 412 is used for receiving line data from the timing controller 400 via the data bus. When the timing controller 400 determines that two consecutive line data are identical and the source driver 410 is in the normal mode, the data receiver 412 receives a sleep command from the timing controller 400, and therefore the source driver 410 enters the sleep mode to stop receiving the line data from the timing controller 400, in order to save power consumption. In such a situation, the data receiver 412 is turned off and stops receiving the line data. Since the data receiver 412 is turned off in the sleep mode, the data receiver 412 may not be used for detecting the wake-up command; hence, the wake-up command is transmitted by the signal transmitter 406 via a control signal line other than the data bus. The wake-up detector 414 is applied to receive the wake-up command from the timing controller 400 when the source driver 410 is in the sleep mode. After the wake-up command is received, the source driver 410 may exit the sleep mode (or enter the normal mode) , and the data receiver 412 is turned on and restarts to receive the line data.

In the source driver 410, the output buffer 428 is used for transmitting the output data to the display panel (not illustrated) of the display system 40. The output buffer 428 outputs a line data stored in the data latch 422 when an LD signal is received. When the source driver 410 is in the normal mode, the data stored in the data latch 422 is updated with the data received from the data receiver 412, and the shift register 420 controls the data latch 422 to receive data channel by channel. When the source driver 410 is in the sleep mode, the data stored in the data latch 422 does not need to be updated since the line data to be displayed is identical to its previous line data. In such a situation, the output buffer 428 outputs the line data stored in the data latch 422 as in the normal mode. The shift register 420 may be turned off since the update operation of the data latch 422 is terminated in the sleep mode. In addition, the operations of the level shifter 424 and the DAC 426 may not be influenced by the operation mode of the source driver 410.

The functions of the level shifter 424 and the DAC 426 should be well known by those skilled in the art and will not be narrated herein.

Figure 5:
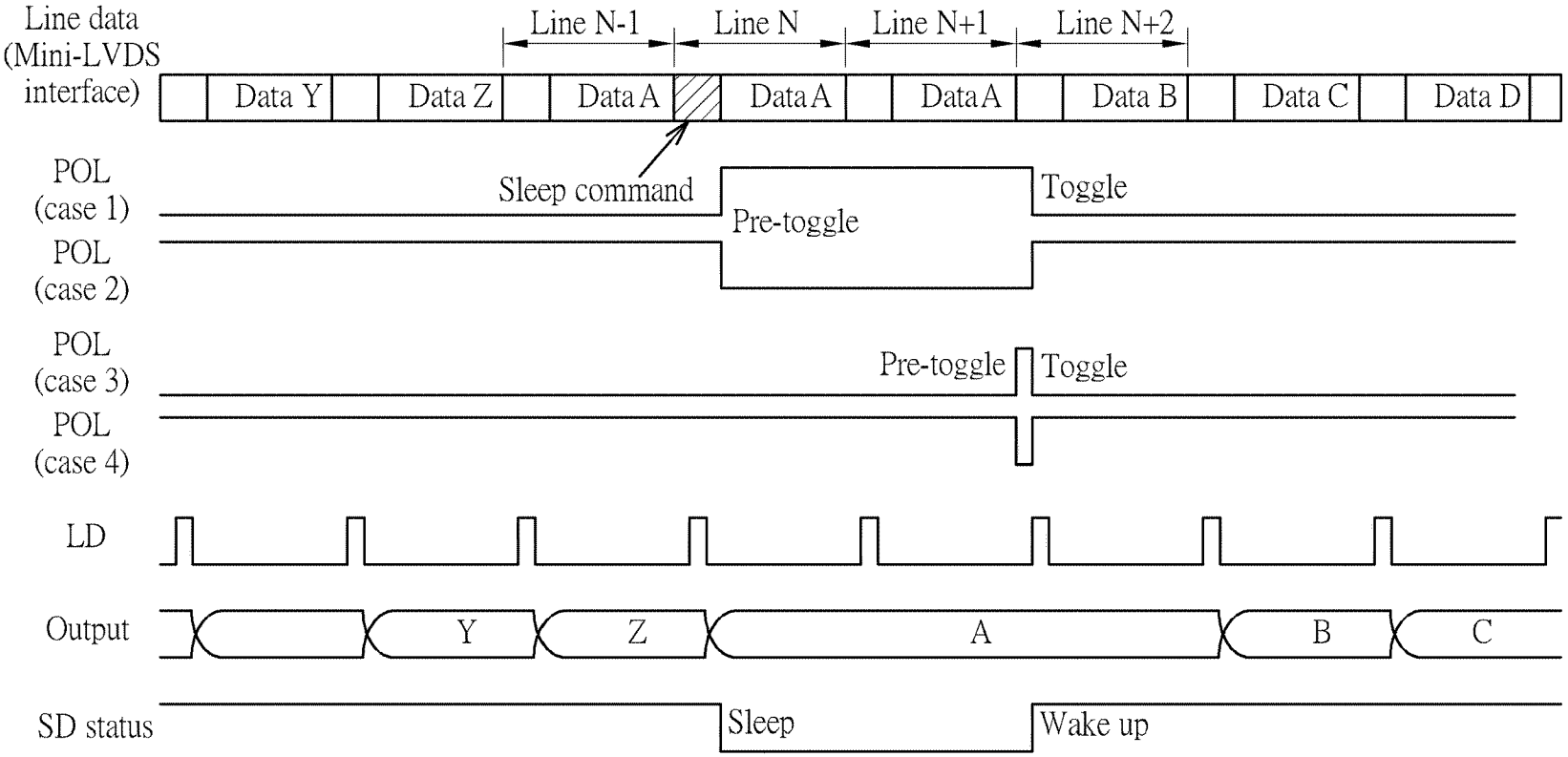
FIG. 5 is a waveform diagram of a display system applied to a mini-LVDS system according to an embodiment of the present invention.

In an embodiment, the display system 40 and the method of controlling the operation mode of the source driver 410 are applied to a mini low voltage differential signaling (mini-LVDS) system, where the timing controller 400 transmits line data to the source driver 410 via a mini-LVDS interface. Please refer to FIG. 5, which is a waveform diagram of a display system (such as the display system 40 shown in FIG. 4) applied to a mini-LVDS system according to an embodiment of the present invention. FIG. 5 illustrates waveforms of line data, LD signals, output data, an SD status signal and a polarity (POL) signal. When the timing controller determines that the line data for lines N−1 and N are identical, the timing controller transmits the sleep command via the mini-LVDS interface. When the source driver is in the sleep mode and the timing controller determines that the line data for lines N+1 and N+2 are different, the timing controller transmits the wake-up command. In this embodiment, the wake-up command is included in the POL signal. In general, when the display system is operated with column inversion or frame inversion, the POL signal may only be triggered between the display of two frames, and may not change its status between the display of two lines. Therefore, the timing controller 400 may change the status of the POL signal to transmit the wake-up command, in order to control the source driver 410 to exit the sleep mode.

Please note that the status of the POL signal should be identical before the source driver 410 enters the sleep mode and after the source driver 410 exits the sleep mode; hence, the POL signal should undergo a pre-toggle in the sleep mode. For example, the POL signal may undergo a pre-toggle when the source driver 410 enters the sleep mode, and then trigger to wake up the source driver 410 by using a toggle such as a falling toggle (e.g., case 1) or a rising toggle (e.g., case 2). In another embodiment, the POL signal may undergo a pre-toggle just before the wake-up signal, where the wake-up signal may be realized by using a toggle such as a falling toggle (e.g., case 3) or a rising toggle (e.g., case 4), as shown in FIG. 5.

Figure 6:
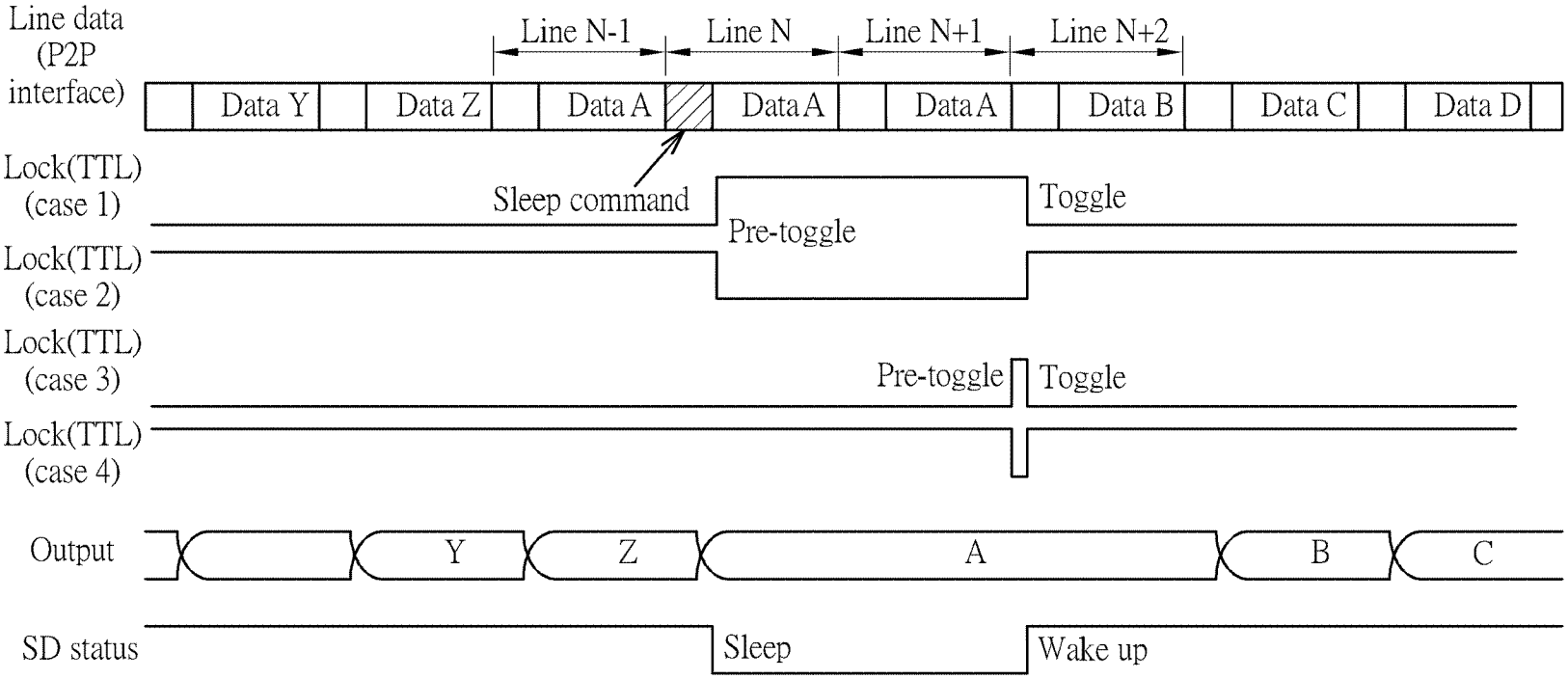
FIG. 6 is a waveform diagram of a display system applied to a P2P interface according to an embodiment of the present invention.

In an embodiment, the display system 40 and the method of controlling the operation mode of the source driver 410 are applied to a point to point (P2P) interface coupled between the timing controller 400 and the source driver 410. Please refer to FIG. 6, which is a waveform diagram of a display system (such as the display system 40 shown in FIG. 4) applied to a P2P interface according to an embodiment of the present invention. FIG. 6 illustrates waveforms of line data, LD signals, output data, an SD status signal and a lock signal. In this embodiment, the lock signal is used for transmitting the wake-up command. In general, the lock signal maybe a bidirectional signal transmitted via a transistor-transistor logic (TTL) interface, where the source driver 410 may use the lock signal to notify the timing controller 400 that the phase and frequency of data received from the timing controller 400 is in a locked status. When the source driver 410 is in the sleep mode, the source driver 410 stops receiving data from the timing controller 400, and thus the lock signal becomes a "don't care" signal. In such a situation, the lock signal may serve as the wake-up command when the source driver 410 is in the sleep mode, which may not influence the preconfigured function of the lock signal. The timing controller 400 may change the status of the lock signal to trigger the source driver 410 to wake up, i.e., exit the sleep mode. The detailed implementations of the wake-up signal include 4 cases as shown in FIG. 6, and the detailed operations are similar to those related to the POL signal. Other operations regarding transmissions of the line data and sleep command are similar to those in the mini-LVDS system, and will not be narrated herein.

Please note that the present invention aims at providing a method of controlling the source driver to enter a sleep mode when two consecutive line data are determined to be identical. Those skilled in the art may make modifications and alternations accordingly. For example, the structure of the display system 40 shown in FIG. 4 is only one of various implementations of the present invention. In another embodiment, there may be several source drivers controlled by the timing controller. The method of the present invention is also applicable to the structure including multiple source drivers. For example, the timing controller may respectively control each source driver to enter the sleep mode or not according to whether the line data corresponding to the source driver is identical.

To sum up, the present invention provides a method of handling operations of a source driver in a display system, allowing the source driver to enter a sleep mode when the timing controller determines that a line data to be transmitted is identical to its previous line data. The timing controller may transmit a sleep command to the source driver, where the sleep command instructs the source driver to enter the sleep mode. The sleep command may be transmitted via the data bus. When the source driver is in the sleep mode, the timing controller may transmit a wake-up command to the source driver, where the wake-up command instructs the source driver to exit the sleep mode. When the source driver is in the sleep mode, the data receiver of the source driver may be turned off, such that the wake-up command may be transmitted via a control signal line other than the data bus. The wake-up command may be transmitted via an existing control signal line for a preconfigured function which does not operate in the sleep mode; hence, the implementation of the wake-up operation may not increase any hardware cost. In such a situation, the source driver may stop receiving data from the timing controller when the line data to be received by the source driver is identical to its previous line data. Therefore, the source driver has the benefit of saving power consumption without influencing the output data of the source driver.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of handling operation of a source driver of a display system used in a timing controller of the display system, the timing controller coupled to the source driver via a data bus for delivering a plurality of line data, the method comprising:

determining whether a first line data among the plurality of line data is identical to a second line data among the plurality of line data previous to the first line data;

transmitting a sleep command to the source driver when the first line data is determined to be identical to the second line data, wherein the sleep command instructs the source driver to enter a sleep mode and turn off a data receiver and stop receiving the plurality of line data;

determining whether a third line data among the plurality of line data is identical to the first line data; and transmitting a wake-up command to the source driver when the source driver is in the sleep mode and the third line data is determined to be not identical to the first line data, wherein the wake-up command instructs the source driver to exit the sleep mode.

2. The method of claim 1, wherein transmission of the sleep command is between the first line data and the second line data via the data bus.

3. The method of claim 1, wherein the wake-up command is transmitted via a control signal line other than the data bus.

4. A method of handling operation of a source driver of a display system used in the source driver, the source driver coupled to a timing controller of the display system via a data bus for delivering a plurality of line data, the source driver comprising a data receiver for receiving the plurality of line data, the method comprising:

receiving a sleep command from the timing controller; and entering a sleep mode to turn off the data receiver and stop receiving the plurality of line data from the timing controller when the sleep command is received;

wherein a shift register of the source driver is turned off in the sleep mode.

5. The method of claim 4, wherein the sleep command is transmitted via the data bus.

6. The method of claim 4, further comprising:

receiving a wake-up command from the timing controller when the source driver is in the sleep mode; and exiting the sleep mode and restarting to receive the plurality of line data when the wake-up command is received.

7. The method of claim 6, wherein the wake-up command is received via a control signal line other than the data bus.

8. The method of claim 4, wherein the source driver keeps transmitting the plurality of line data to a display panel of the display system when the source driver is in the sleep mode.

9. A timing controller of a display system for delivering a plurality of line data to a source driver via a data bus, the timing controller comprising:

a determination module, for determining whether a first line data among the plurality of line data is identical to a second line data among the plurality of line data previous to the first line data; and a data transmitter, for transmitting a sleep command to the source driver when the first line data is determined to be identical to the second line data, wherein the sleep command instructs the source driver to enter a sleep mode and turn off a data receiver and stop receiving the plurality of line data;

wherein the determination module further determines whether a third line data among the plurality of line data is identical to the first line data, and the timing controller further comprises:

a signal transmitter, for transmitting a wake-up command to the source driver when the source driver is in the sleep mode and the third line data is determined to be not identical to the first line data, wherein the wake-up command instructs the source driver to exit the sleep mode.

10. The timing controller of claim 9, wherein transmission of the sleep command is between the first line data and the second line data via the data bus.

11. The timing controller of claim 9, wherein the wake-up command is transmitted via a control signal line other than the data bus.

12. A source driver of a display system, the source driver comprising:

a data receiver, for receiving a sleep command and a plurality of line data from a timing controller; and an output buffer, for transmitting the plurality of line data to a display panel of the display system;

wherein the source driver enters a sleep mode to turn off the data receiver and stop receiving the plurality of line data from the timing controller when the sleep command is received;

wherein a shift register of the source driver is turned off in the sleep mode.

13. The source driver of claim 12, wherein the sleep command is transmitted via a data bus.

14. The source driver of claim 12, further comprising:

a wake-up detector, for receiving a wake-up command from the timing controller when the source driver is in the sleep mode;

wherein the source driver exits the sleep mode and restarts to receive the plurality of line data when the wake-up command is received.

15. The source driver of claim 14, wherein the wake-up command is received via a control signal line other than the data bus.

16. The source driver of claim 12, wherein the source driver keeps transmitting the plurality of line data to the display panel of the display system when the source driver is in the sleep mode.

* * * * *